US009637841B2

(12) United States Patent
Matsumoto et al.

(10) Patent No.: US 9,637,841 B2
(45) Date of Patent: May 2, 2017

(54) FIBER FOR ARTIFICIAL HAIR AND ARTIFICIAL HAIR PRODUCT USING THE SAME

(75) Inventors: Yoshitomo Matsumoto, Osaka (JP); Shin Sudo, Takasago (JP); Mitsuru Furukawa, Osaka (JP); Kazuaki Fujiwara, Takasago (JP); Masahiko Mihoichi, Takasago (JP)

(73) Assignee: KANEKA CORPORATION, Osaka (JP)

( * ) Notice: Subject to any disclaimer, the term of this patent is extended or adjusted under 35 U.S.C. 154(b) by 1373 days.

(21) Appl. No.: 13/055,705

(22) PCT Filed: Jul. 8, 2009

(86) PCT No.: PCT/JP2009/062462

§ 371 (c)(1),
(2), (4) Date: Jan. 24, 2011

(87) PCT Pub. No.: WO2010/010817

PCT Pub. Date: Jan. 28, 2010

(65) Prior Publication Data

US 2011/0120484 A1 May 26, 2011

(30) Foreign Application Priority Data

Jul. 22, 2008 (JP) ..... 2008-188999

(51) Int. Cl.
*B32B 19/00* (2006.01)
*D01F 4/00* (2006.01)
(Continued)

(52) U.S. Cl.
CPC ..... *D01F 4/00* (2013.01); *A41G 3/0083* (2013.01); *D01D 5/253* (2013.01); *Y10T 428/2973* (2015.01); *Y10T 428/2975* (2015.01)

(58) Field of Classification Search
USPC ..... 428/357
See application file for complete search history.

(56) References Cited

U.S. PATENT DOCUMENTS 6,242,573 B1 * 6/2001 Goto et al. ..... 530/356
2006/0154062 A1 7/2006 Kowaki et al.
(Continued)

FOREIGN PATENT DOCUMENTS

JP 43-25829 11/1968
JP 43-25829 B 11/1968
(Continued)

OTHER PUBLICATIONS

Vernall D. "A study of the shape and size of the cross section of hair from four races of men" Department of Anatomy, The University of Michigan, Ann arbor, MI 1961 (Vernall). http://www.google.com/search?q=shape+of+cross+section+of+human+hair&sourceid=ie7&rls=com.microsoften-us:IE-SearchBox&ie=&oe=.*
(Continued)

*Primary Examiner* — Jennifer Chriss
*Assistant Examiner* — Ricardo Lopez
(74) *Attorney, Agent, or Firm* — Westerman, Hattori, Daniels & Adrian, LLP

(57) ABSTRACT

A fiber for artificial hair that has an improved appearance with a suppressed gloss is obtained by combining regenerated collagen fibers having different shapes in cross section. An artificial hair product using the same is provided. The fiber for artificial hair according to the present invention is obtained by combining fibers having different shapes in cross section. The fiber for artificial hair includes regenerated collagen fibers, and the regenerated collagens fibers include at least two types of regenerated collagen fibers whose cross-sectional shapes are selected from the group consisting of shapes including an elliptical shape, a circular
(Continued)

Shape of sexfoil nozzle shape, and a multifoil shape. The artificial hair product of the present invention includes the above-described fiber for artificial hair.

3 Claims, 13 Drawing Sheets

(51) Int. Cl.
*A41G 3/00* (2006.01)
*D01D 5/253* (2006.01)

(56) References Cited

U.S. PATENT DOCUMENTS

| | | | | |
|---|---|---|---|---|
| 2006/0194044 | A1 | 8/2006 | Kowaki et al. | |
| 2007/0232169 | A1* | 10/2007 | Strickler et al. | 442/181 |
| 2009/0173356 | A1 | 7/2009 | Kano | |
| 2009/0260646 | A1* | 10/2009 | Masuda | 132/53 |

FOREIGN PATENT DOCUMENTS

| | | | |
|---|---|---|---|
| JP | 43-27513 | | 11/1968 |
| JP | 43-27513 | B | 11/1968 |
| JP | 46-15033 | | 4/1971 |
| JP | 46-15033 | B | 4/1971 |
| JP | 46-47443 | U | 6/1971 |
| JP | 2002-249982 | | 9/2002 |
| JP | 2002-249982 | A | 9/2002 |
| JP | 2003-027318 | | 1/2003 |
| JP | 2003-027318 | A | 1/2003 |
| JP | 2005-120533 | | 5/2005 |
| JP | 2005-120533 | A | 5/2005 |
| JP | 2007-169806 | | 7/2007 |
| JP | 2007-169806 | A | 7/2007 |
| JP | 2007-177370 | | 7/2007 |
| JP | 2007-177370 | A | 7/2007 |
| WO | 2007/114422 | A1 | 10/2007 |

OTHER PUBLICATIONS

Chinese Office Action dated Jul. 17, 2013, issued in corresponding Chinese Patent Application No. 200980128692.5.

* cited by examiner

| Name | Cross-sectional shape | Fineness (dtex) | Nozzle shape | Actual cross-sectional shape of fiber | |
|---|---|---|---|---|---|
| Ellipse 100 | Elliptical | 1 0 0 | Minor axis 0.20mm<br>Major axis 0.53mm<br><br>Aspect ratio 2.65 | | Major axis 0.11～0.14mm<br>(Average 0.12mm)<br>Minor axis 0.05～0.08mm<br>(Average 0.07mm)<br><br>Aspect ratio 1.6～2.2 (Average 1.75) |
| Ellipse 78 | Elliptical | 7 8 | Minor axis 0.18mm<br>Major axis 0.45mm<br><br>Aspect ratio 2. 5 | | Major axis 0.08～0.12mm<br>(Average 0.10mm)<br>Minor axis 0.05～0.07mm<br>(Average 0.06mm)<br><br>Aspect ratio 1.5～1.9 (Average 1.65) |
| Ellipse 65 | Elliptical | 6 5 | Minor axis 0.18mm<br>Major axis 0.45mm<br><br>Aspect ratio 2. 5 | | Major axis 0.06～0.12mm<br>(Average 0.09mm)<br>Minor axis 0.04～0.08mm<br>(Average 0.06mm)<br><br>Aspect ratio 1.3～1.9 (Average 1.5) |
| Ellipse 58 | Elliptical | 5 8 | Minor axis 0.14mm<br>Major axis 0.31mm<br><br>Aspect ratio 2. 2 | | Major axis 0.06～0.11mm<br>(Average 0.085mm)<br>Minor axis 0.04～0.08mm<br>(Average 0.06mm)<br><br>Aspect ratio 1.3～1.8 (Average 1.5) |
| Ellipse 52 | Elliptical | 5 2 | Minor axis 0.14mm<br>Major axis 0.31mm<br><br>Aspect ratio 2. 2 | | Major axis 0.06～0.085mm<br>(Average 0.075mm)<br>Minor axis 0.04～0.07mm<br>(Average 0.055mm)<br><br>Aspect ratio 1.3～1.7 (Average 1.5) |

FIG. 1

| | | | | | |
|---|---|---|---|---|---|
| ○52 | Circular | 52 | Pore diameter 0.22 mm | 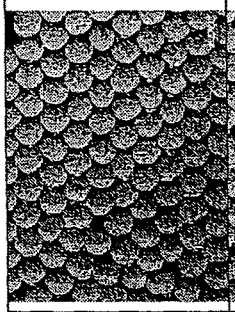 | Average diameter 0.066mm |
| ○65 | Circular | 65 | Pore diameter 0.25 mm | 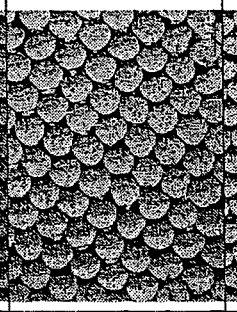 | Average diameter 0.074mm |
| ○39 | Circular | 39 | Pore diameter 0.19 mm | 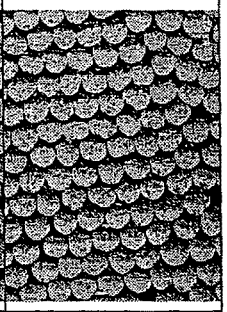 | Average diameter 0.057mm |
FIG. 2

| | | | | | |
|---|---|---|---|---|---|
| ＊５２ | Sexfoil | ５２ | Figure below<br>a=0.24mm<br>b=0.16mm<br>R=0.041mm | | a=0.062～0.075(Average 0.068)<br>b=0.055～0.070(Average 0.058)<br>a/b=1.1～1.4(Average 1.2) |
| ＊６５ | Sexfoil | ６５ | Figure below<br>a=0.25mm<br>b=0.17mm<br>R=0.043mm | | a=0.071～0.084(Average 0.076)<br>b=0.057～0.069(Average 0.063)<br>a/b=1.1～1.4(Average 1.2) |
| ＊３９ | Sexfoil | ３９ | Figure below<br>a=0.16mm<br>b=0.12mm<br>R=0.03mm | | a=0.058～0.067(Average 0.062)<br>b=0.04～0.05(Average 0.045)<br>a/b=1.2～1.6(Average 1.3) |

FIG. 3

Shape of sexfoil nozzle

FIBER FOR ARTIFICIAL HAIR AND ARTIFICIAL HAIR PRODUCT USING THE SAME

TECHNICAL FIELD

The present invention relates to a fiber for artificial hair that includes regenerated collagen fibers and an artificial hair product using the same.

BACKGROUND ART

Regenerated collagen fibers, which are composed of proteins, are similar to human hair in composition and have a soft texture (touch), and hence they have been proposed conventionally as fibers for artificial hair (Patent Documents 1 to 3). In order to make regenerated collagen fibers more similar to human hair, they preferably have an elliptical shape in cross section.

However, regenerated collagen fibers have a problem in that they are too high in gloss, which leads to an undesirable poor appearance. In particular, regenerated collagen fibers having an elliptical shape in cross section are more likely to show this tendency. A hair product with a high gloss fiber, as compared with that of human hair or the like, produces a feeling of strangeness sense of artificiality, resulting in a low reduced commercial value for the product.

PRIOR ART DOCUMENT

Patent Document

Patent Document 1: JP 2007-177370A
Patent Document 2: JP 2007-169806A
Patent Document 3: JP 2003-027318A

DISCLOSURE OF INVENTION

Problem to be Solved by the Invention

In order to solve the above-described conventional problem, the present invention provides a fiber for artificial hair that has an improved appearance with a suppressed gloss by combining regenerated collagen fibers having different shapes in cross section and an artificial hair product using the same.

Means for Solving Problem

A fiber for artificial hair according to the present invention is obtained by combining fibers having different shapes in cross section. The fiber for artificial hair includes regenerated collagen fibers, and the regenerated collagens fibers include at least two types of regenerated collagen fibers whose cross-sectional shapes are selected from the group consisting of shapes including an elliptical shape, a circular shape, and a multifoil shape.

An artificial hair product according to the present invention includes the above-described fiber for artificial hair.

Effects of the Invention

The fiber for artificial hair and the artificial hair product according to the present invention include regenerated collagen fibers, in which at least two types of regenerated collagen fibers whose cross-sectional shapes are selected from the group consisting of shapes including an elliptical shape, a circular shape, and a multifoil shape are combined, thereby achieving an improved appearance with a suppressed gloss.

BRIEF DESCRIPTION OF DRAWINGS

FIG. 1 is a drawing for explaining cross sections of regenerated collagen fibers in Manufacturing Examples 1 to 5 of the present invention.

FIG. 2 is a drawing for explaining cross sections of regenerated collagen fibers in Manufacturing Examples 6 to 8 of the present invention.

FIG. 3 is a drawing for explaining cross sections of regenerated collagen fibers in Manufacturing Examples 9 to 11 of the present invention.

DESCRIPTION OF THE INVENTION

Figure 4:
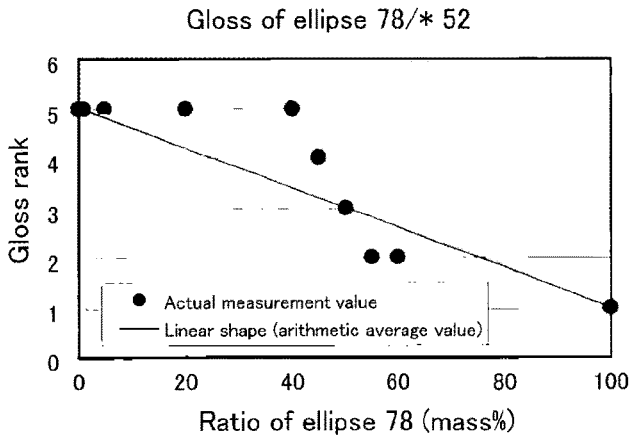
FIG. 4 is a graph showing a gloss rank of a fiber for artificial hair obtained in Example 1 of the present invention.

A fiber for artificial hair according to the present invention is obtained by combining fibers having different shapes in cross section. Examples of the cross-sectional shape include various shapes such as an elliptical shape, a circular shape, a multifoil shape, a polygonal shape, a cocoon shape, a dog bone shape, a half-moon shape, a crescent shape, a ‡-shape, an indeterminate shape attendant on the coagulation of a solvent in wet spinning. According to an embodiment of the present invention, at least two types of fibers whose cross-sectional shapes are selected from shapes including at least an elliptical shape, a circular shape, and a multifoil shape are used. As a matter of course, a fiber having another shape in cross section also may be included. The above-described multifoil shape is preferably a trefoil to double cinquefoil shape. Combining fibers refers to mixing fibers, which may be performed in any step around a spinning step, a drawing step, a heat treatment step, a towing step, and a cutting step.

In the present invention, the fiber obtained by combining fibers having different shapes in cross section may be formed of 100 mass % of regenerated collagen fibers or include regenerated collagen fibers. The mixing ratio of the regenerated collagen fibers is preferably 50 to 100 mass %, more preferably 60 to 100 mass %, and particularly preferably 70 to 100 mass %. In the case of including other fibers as well as the regenerated collagen fibers, the other fibers are not limited particularly and may be vinyl chloride fibers, acrylic fibers, modacrylic fibers, polyester fibers, polyamide fibers, polyolefin fibers, human hair, or the like.

When the regenerated collagen fibers of the present invention include regenerated collagen fibers having two kinds of shapes including an elliptical shape (with the other being a circular or mutifoil shape) in cross section, it is preferable that 1 to 49 mass % of the regenerated collagen fibers having an elliptical shape in cross section are combined with respect to 100 mass % of the entire fiber for artificial hair. The lower limit is more preferably 5 mass %, further preferably 10 mass %, and particularly preferably 20 mass %. The upper limit is more preferably 48 mass % and further preferably 45 mass %.

When the regenerated collagen fibers of the present invention include regenerated collagen fibers having a circular shape and a multifoil shape, rather than an elliptical shape, in cross section, the mixing ratio by mass of the regenerated collagen fibers having a circular shape in cross section and the regenerated collagen fibers having a multifoil shape in cross section is preferably 1/99 to 99/1, more preferably 5/95 to 95/5, further preferably 5/95 to 80/20, still more preferably 5/95 to 60/40, and particularly preferably 5/95 to 40/60.

When the regenerated collagen fibers of the present invention include regenerated collagen fibers having three kinds of shapes, i.e., a circular shape, an elliptical shape, and a multifoil shape, in cross section, 50 mass % of the regenerated collagen fibers having an elliptical shape in cross section may be included with respect to 100 mass % of the entire regenerated collagen fibers having the three kinds of shapes in cross section. Further, in the case of including 50 mass % of the regenerated collagen fibers having an elliptical shape in cross section and a fineness of 78 dtex, the mixing ratio by mass of the regenerated collagen fibers having a circular shape in cross section and the regenerated collagen fibers having a multifoil shape in cross section is preferably 50/0 to 5/45. In the case of including 50 mass % of the regenerated collagen fibers having an elliptical shape in cross section and a fineness of 65 dtex, the mixing ratio by mass of the regenerated collagen fibers having a circular shape in cross section and the regenerated collagen fibers having a multifoil shape in cross section is preferably 40/10 to 5/45. In the case of including 50 mass % of the regenerated collagen fibers having an elliptical shape in cross section and a fineness of 58 dtex, the mixing ratio by mass of the regenerated collagen fibers having a circular shape in cross section and the regenerated collagen fibers having a multifoil shape in cross section is preferably 40/10 to 5/45. In the case of including 50 mass % of the regenerated collagen fibers having an elliptical shape in cross section and a fineness of 50 dtex, the mixing ratio by mass of the regenerated collagen fibers having a circular shape in cross section and the regenerated collagen fibers having a multifoil shape in cross section is preferably 10/40 to 5/45.

When the mixing ratio by mass of the regenerated collagen fibers having a circular shape in cross section and the regenerated collagen fibers having a multifoil shape in cross section is in a range of 30/15 to 5/40, about 55 mass % of the regenerated collagen fibers having an elliptical shape in cross section may be included.

The multifoil shape is more preferably a cinquefoil to octofoil shape and further preferably a sexfoil shape.

The fiber for artificial hair preferably has a fineness in a range of 30 to 120 dtex, because the fineness in this range allows the fiber to be similar to human hair and have a good texture.

A human hair product according to the present invention may be any product such as a hairpiece, a partial hairpiece, a wig, a weaving and the like.

The fiber is preferably straight but may be curled, waved, permed, or the like as artificial hair of general applicability.

The regenerated collagen fibers are made of the skin, bones, tendons, and the like of animals such as bovines, pigs, horses, deer, rabbits, birds, and fish. A solubilized collagen solution, which is produced from these materials, is spun into regenerated collagen fibers, followed by cross-linking with an aluminum compound. By the dense aluminum cross-linking performed immediately after the spinning, the regenerated collagen fibers of the present invention can be obtained.

It is preferable that a flesh split portion is used as a material for producing regenerated collagen as disclosed in JP 2002-249982 A, for example. The flesh split is obtained from a fresh hide or salted rawhide of animals such as bovines, pigs, horses, deer, rabbits, birds, and fish. The flesh split is mainly composed of insoluble collagen fibers. A fleshy portion usually attached to the fibers in the form of a network is removed along with a salt used to prevent corrosion and alternation, before the flesh split is used. Other materials such as bones and tendons of animals as described above can be used as well.

The insoluble collagen fibers contain impurities including lipids such as glyceride, phospholipid, and a free fatty acid, proteins other than collagen such as glycoprotein and albumin, and the like. These impurities significantly affect quality such as gloss and strength, odor, and the like when being spun into fibers. Thus, it is preferable that the impurities are removed in advance by, for example, liming the flesh split to hydrolyze a fat component in the insoluble collagen fibers and disentangling the collagen fibers, followed by a common leather treatment such as an acid/alkali treatment, an enzyme treatment, and a solvent treatment.

The insoluble collagen treated as described above is then subjected to a solubilization process to dissociate cross-linked peptide portions. The solubilization process may be a commonly used and well-known alkali solubilization process, enzyme solubilization process, or the like. In the case of using the alkali solubilization process, it preferably includes neutralization with an acid such as a hydrochloric acid. Also, a method described in JP 46 (1971)-15033 B may be used, which is an improved method of the conventionally known alkali solubilization process.

The enzyme solubilization process has the advantage of being able to provide regenerated collagen with a uniform molecular weight, and may be used suitably in the present invention. Such an enzyme solubilization process may be a process described in, for example, JP 43 (1968)-25829 B, JP 43 (1968)-27513 B, or the like. Further, the alkali solubilization process and the enzyme solubilization process may be used in combination.

It is preferable that the thus solubilized collagen is further subjected to operations such as a pH adjustment, salting-out, washing, and a solvent treatment, since these operations can impart excellent quality to the regenerated collagen. The resultant solubilized collagen is dissolved in an acid solution whose pH is adjusted to 2 to 4.5 with a hydrochloric acid, an acetic acid, a lactic acid, or the like to form a stock solution having a predetermined concentration of about 1 to 15 mass % and preferably about 2 to 10 mass %, for example. The thus-obtained collagen aqueous solution, if necessary, may be defoamed under reduced pressure and then filtered so that small unwanted substances that are insoluble in water are removed. Moreover, the resultant solubilized collagen aqueous solution, if necessary, may be blended with an appropriate amount of an additive such as a stabilizer and a water-soluble polymer compound in order to improve mechanical strength, water and heat resistance, gloss, and spinnability, as well as to prevent coloring and corrosion, for example.

The solubilized collagen aqueous solution obtained as described above is spun into fibers using a wet spinning method. The solubilized collagen aqueous solution is passed through a spinning nozzle, for example, and discharged to an inorganic salt aqueous solution, thereby forming regenerated collagen fibers. The inorganic salt aqueous solution may be, for example, an aqueous solution of a water-soluble inorganic salt such as a sodium sulfate, a sodium chloride, and an ammonium sulfate. The concentration of the inorganic salt is adjusted usually to 10 to 40 mass %. The pH of the inorganic salt aqueous solution is adjusted usually to 2 to 13 and preferably 4 to 12 by the addition of a metal salt such as sodium borate and sodium acetate, a hydrochloric acid, a boric acid, an acetic acid, a sodium hydroxide, or the like. When the pH is within the above-described range, the peptide bond of the collagen is less likely to undergo hydrolysis, so that the intended regenerated collagen fibers can be obtained. The temperature of the inorganic salt aqueous solution is not limited particularly but, in general, is desirably 35° C. or less. When the temperature is 35° C. or less, the solubilized collagen is not denatured, so that stable production can be achieved with a high strength maintained. The lower limit of the temperature is not limited particularly and, in general, may be adjusted appropriately in accordance with the solubility of the inorganic salt.

A free amino group of the collagen is modified with an alkyl group having a hydroxyl group or an alkoxy group in the β-position or the γ-position and a carbon number of 2 to 20 in the main chain. Herein, the carbon number in the main chain refers to a continuous carbon chain of the alkyl group bonded to the amino group, and the number of carbon atoms that are present with another atom intervening therebetween is not taken into account. The reaction to modify the free amino group can be a commonly known alkylation reaction of the amino group. In view of reactivity, ease of treatment after the reaction, and the like, the alkyl group having a hydroxyl group or an alkoxy group in the β-position and a carbon number of 2 to 20 is preferably a compound expressed by the following general formula (2):

$$—CH_2—CH(OX)—R \quad (2)$$

where R represents a substituent expressed as $R^1$—, $R^2$—O—$CH_2$—, or $R^2$—COO—$CH_2$—, $R^1$ in the substituent represents a hydrocarbon group having a carbon number of 2 to 20 inclusive or $CH_2Cl$, $R^2$ in the substituent represents a hydrocarbon group having a carbon number of 4 to 20 inclusive, and X represents hydrogen or a hydrocarbon group.

Preferred examples of the general formula (2) include a glycidyl group, a 1-chloro-2-hydroxypropyl group, and a 1,2-dihydroxypropyl group. In addition, the general formula (2) may include a structure in which a glycidyl group is added to the free amino group of the collagen. Further, the general formula (2) may include a structure formed by the ring-opening addition and/or ring-opening polymerization of an epoxy compound used, with the hydroxyl group of the alkyl group, which is described as a preferred group above, as a starting point. In this case, an end structure obtained as a result of the addition and/or polymerization may be the alkyl group having the above-described structure.

The amino acids that constitute the free amino group of the regenerated collagen include lysine and hydroxylysine. While arginine is present as one of the amino acids that originally constitute the collagen, when hydrolysis is performed under the alkaline condition to provide the regenerated collagen, it is partially hydrolyzed and produces ornithine, and the amino group thereof is also involved in the alkylation reaction. In addition, the reaction also proceeds due to secondary amine of histidine.

The modification ratio of the free amino group can be measured by amino acid analysis, and is calculated based on a value determined by the amino acid analysis of the regenerated collagen fibers before the alkylation reaction or a known composition of the free amino acid that constitutes the collagen used as a material. In the present invention, 50% or more of the free amino group may be modified with the alkyl group having a hydroxyl group or an alkoxy group in the β-position or the γ-position and a carbon number of 2 or more. Other portions may remain the free amino group or be modified with another substituent. The modification ratio of the free amino group of the regenerated collagen needs to be 50% or more, more preferably 65% or more, and further preferably 80% or more. If the reactivity is low, good heat resistance cannot be achieved.

In the modification of the free amino group, one molecule of an alkylating agent usually reacts per free amino group. Needless to say, two or more molecules may react. Further, an intramolecular or intermolecular cross-linking reaction may occur via the hydroxyl group or the alkoxy group in the β-position or the γ-position of the alkyl group bonded to the free amino group, or via other functional groups. Specific examples of the alkylation reaction include the following: an addition reaction of an epoxy compound; an addition reaction of an aldehyde compound having a hydroxyl group or its derivative in the α-position or the β-position along with a subsequent reduction reaction; and a substitution reaction of a halide, alcohol, amine, or the like having a hydroxyl group or an alkoxy group in the β-position or the γ-position and a carbon number of 2 or more. However, the alkylation reaction is not limited thereto.

In the present invention, organic compounds that can be used as the alkylating agent include aldehydes, epoxies, phenol derivatives, and the like. Among them, in view of reactivity and ease of treatment conditions, an epoxy compound is preferable because the modification reaction with the epoxy compound exhibits excellent properties. In particular, a monofunctional epoxy compound is preferable.

Specific examples of the monofunctional epoxy compound that can be used herein include the following; olefin oxides such as an ethylene oxide, a propylene oxide, a butylene oxide, an isobutylene oxide, an octene oxide, a styrene oxide, a methyl styrene oxide, epichlorohydrin, epibromohydrin, and glycidol; glycidyl ethers such as glycidyl methyl ether, butyl glycidyl ether, octyl glycidyl ether, nonyl glycidyl ether, undecyl glycidyl ether, tridecyl glycidyl ether, pentadecyl glycidyl ether, 2-ethylhexyl glycidyl ether, allyl glycidyl ether, phenyl glycidyl ether, cresyl glycidyl ether, t-butylphenyl glycidyl ether, dibromophenyl glycidyl ether, benzyl glycidyl ether, and polyethylene oxide glycidyl ether; glycidyl esters such as glycidyl formate, glycidyl acetate, glycidyl acrylate, glycidyl methacrylate, and glycidyl benzoate; and glycidyl amides. However, the monofunctional epoxy compound is not limited thereto.

Among the monofunctional epoxy compounds, a monofunctional epoxy compound expressed by the following general formula (1) is used preferably because the water absorption of the regenerated collagen is reduced.

[Chemical Formula 1]

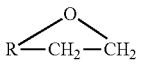

(1)

In the above-described formula (1), R represents a substituent expressed as $R^1$—, $R^2$—O—$CH_2$—, or $R^2$—COO—$CH_2$—, $R^1$ represents a hydrocarbon group having a carbon number of 2 to 20 inclusive or $CH_2Cl$, and $R^2$ represents a hydrocarbon group having a carbon number of 4 to 20 inclusive.

The regenerated collagen fibers thus obtained are swollen with water or the inorganic salt aqueous solution. It is preferable that these swollen fibers contain water or the inorganic salt aqueous solution in an amount 4 to 15 times the weight of the regenerated collagen. When the content of water or the inorganic salt aqueous solution is 4 times or more, the regenerated collagen fibers have a high content of aluminum salt and thus are sufficiently water-resistant. When the content is 15 times or less, the regenerated collagen fiber has a good handling property with no strength degradation.

The swollen regenerated collagen fibers are then immersed in an aluminum salt aqueous solution. The aluminum salt contained in the aluminum salt aqueous solution is preferably a basic aluminum chloride or a basic aluminum sulfate expressed as $Al(OH)_nCl_{3-n}$ or $Al_2(OH)_{2n}(SO_4)_{3-n}$ (where n is 0.5 to 2.5). Specific examples include an aluminum sulfate, an aluminum chloride, and alum. These aluminum salts can be used alone or in combination of two or more. The concentration of the aluminum salt in the aluminum salt aqueous solution is preferably 0.3 to 5 mass %, which is expressed in terms of aluminum oxide. When the aluminum salt concentration is 0.3 mass % or more, the regenerated collagen fibers have a high content of aluminum salt and thus are sufficiently water-resistant. When the aluminum salt concentration is 5 mass % or less, the regenerated collagen fibers are not so hard after the treatment and have a good handling property.

The pH of the aluminum salt aqueous solution is adjusted usually to 2.5 to 5 with, for example, a hydrochloric acid, a sulfuric acid, an acetic acid, a sodium hydroxide, a sodium carbonate, or the like. When the pH is 2.5 or more, the collagen structure can be maintained suitably. When the pH is 5 or less, the aluminum salt aqueous solution is likely to penetrate uniformly with no precipitation of the aluminum salt occurring. It is preferable that the pH is first adjusted to 2.2 to 3.5 so that the aluminum salt aqueous solution penetrates fully into the regenerated collagen, and then adjusted to 3.5 to 5 by the addition of, for example, a sodium hydroxide, a sodium carbonate, or the like, thereby completing the treatment. In the case of using the aluminum salt that is highly basic, only the first pH adjustment to 2.5 to 5 may be sufficient. The temperature of the aluminum salt aqueous solution is not limited particularly but is preferably 50° C. or less. When the temperature is 50° C. or less, the regenerated collagen is less likely to be denatured or altered.

The regenerated collagen fibers are immersed in the aluminum salt aqueous solution for 3 hours or more and preferably 6 to 25 hours. When the immersion time is 3 hours or more, the reaction of the aluminum salt proceeds, allowing the regenerated collagen to be sufficiently water-resistant. Although there is no particular upper limit to the immersion time, the reaction of the aluminum salt proceeds sufficiently within 25 hours, allowing the regenerated collagen to be suitably water resistant. In order to prevent variations in concentration, which are caused when the aluminum salt is absorbed quickly into the regenerated collagen, an inorganic salt such as a sodium chloride, a sodium sulfate, and a potassium chloride may be added appropriately to the aluminum salt aqueous solution.

In the present invention, it is preferable that the treatment is performed so that the fibers after the treatment contain 1 to 10 mass % of aluminum and more preferably 3 to 9 mass % of aluminum. If the aluminum content is less than 1 mass %, a wet touch is likely to be poor. If the content is more than 10 mass %, the fibers after the treatment are likely to be hard, and their texture may be impaired.

The regenerated collagen fibers treated with the aluminum salt as described above are then subjected to washing, oiling, and drying. For example, washing can be performed with running water for 10 minutes to 4 hours. Examples of an oil solution for use in oiling include emulsions such as amino-modified silicone, epoxy-modified silicone, and polyether-modified silicone and a Pluronic-type polyether antistatic agent. The drying temperature is preferably 100° C. or less and more preferably 75° C. or less. The load to be applied during drying is 0.01 to 0.25 g and preferably 0.02 to 0.15 g per dtex.

Washing is performed for the purpose of preventing the oil solution from being deposited due to the salt, preventing the regenerated collagen fibers from being cut due to a salt deposited from the regenerated collagen fibers in a drier during drying, and preventing a decrease in heat transfer coefficient due to a generated salt that is scattered in the drier and attached to a regenerator in the drier. Further, oiling is effective in preventing the agglutination of the fibers during drying and improving the surface property of the fibers.

When the collagen solution is spun into fibers, a pigment or dye can be mixed with the solution or added to the solution immediately before spinning (solution dyeing method). The type and color of the pigment or dye to be used may be selected in accordance with the intended use so that it is not eluted or separated during the spinning process and in accordance with the required quality of a product that uses the present invention. A filler, an age inhibitor, a flame retardant, an antioxidant, or the like may be added if necessary.

EXAMPLES

Hereinafter, specific embodiments of the present invention will be described in more detail by way of examples. However, the present invention is not limited to these examples.

(1) Gloss

A bundle of 100 filament fibers were observed visually in natural light and ranked on a scale of 1 to 5 as follows:

5: Gloss equal to that of human hair;
4: Gloss slightly higher than that of human hair;
3: Gloss higher than that of human hair;
2: Gloss quite higher than that of human hair; and
1: Gloss significantly higher than and greatly different from that of human hair.

(2) Fineness

The fineness was measured using an auto-vibronic fineness measuring instrument, Denier Computer (registered trademark) DC-77 A (manufactured by Search Co., Ltd.) in an atmosphere at a temperature of 20° C.±2° C. and a relative humidity of 65%±2%.

Manufacturing Example 1

A bovine flesh split was used as a material, and a hydrogen peroxide aqueous solution diluted to 30 mass % was added to an alkali-solubilized hide piece, followed by dissolution in a lactic acid aqueous solution, whereby a stock solution having a pH of 3.5 and a solid content of 7.5 mass % was produced. The stock solution was stirred and defoamed under a reduced pressure with a stirring/deforming device (8DMV model manufactured by DALTON CO., LTD.), transferred to a piston-type spinning stock solution tank, allowed to stand under a reduced pressure, and defoamed. After the stock solution was extruded by the piston, a constant amount of the stock solution was fed using a gear pump and filtered through a sintered filter having a pore diameter of 10 μm. Then, the stock solution was passed through a spinning nozzle (whose shape is elliptical as shown under the name of "ellipse 100" in FIG. 1) and extruded at a spinning speed of 5 m/minute into a coagulation bath containing 20 mass % of sodium sulfate at 25° C. (in which the pH was adjusted to 11 with a boric acid and a sodium hydroxide).

Then, the regenerated collagen fibers thus obtained were immersed in an aqueous solution containing 1.7 mass % of epichlorohydrin, 0.0246 mass % of sodium hydroxide, and 17 mass % of sodium sulfate (sodium sulfate anhydrous manufactured by Tosoh Corporation) at 25° C. for 4 hours. Then, the temperature of the reaction solution was increased to 43° C., and the regenerated collagen fibers were further immersed therein for 2 hours. The reaction solution was removed after the reaction was finished, and the regenerated collagen fibers were batch washed 3 times with water at 25° C. Then, the regenerated collagen fibers were immersed in an aqueous solution containing 5.0 mass % of aluminum sulfate (sulfate band manufactured by Nippon Light Metal Co.), 0.9 mass % of citric acid trisodium salt (purified sodium citrate M manufactured by Fuso chemical Co., Ltd.), and 1.2 mass % of sodium hydroxide at 30° C., and a 5 mass % sodium hydroxide aqueous solution was added to the reaction solution 2 hours, 3 hours, and 4 hours, respectively, after the start of the reaction. Then, the regenerated collagen fibers were batch washed 3 times with water at 25° C.

Then, part of the produced fibers was immersed in a bath filled with an oil solution including an emulsion of amino-modified silicone and a Pluronic-type polyether antistatic agent, so that the oil solution was adhered to the fibers. The fibers were dried in a hot-air convection drier adjusted at 50° C. under tension. The resultant fibers had an elliptical shape in cross section and a fineness of 100 dtex. The resultant fibers are referred to as "ellipse 100".

Manufacturing Example 2

The regenerated collagen fibers were manufactured in the same manner as in Manufacturing Example 1 except that the stock solution was passed through a spinning nozzle whose shape was elliptical as shown under the name of "ellipse 78" in FIG. 1. The resultant fibers had an elliptical shape in cross section and a fineness of 78 dtex. The resultant fibers are referred to as "ellipse 78".

Manufacturing Example 3

The regenerated collagen fibers were manufactured in the same manner as in Manufacturing Example 1 except that the stock solution was passed through a spinning nozzle whose shape was elliptical as shown under the name of "ellipse 65" in FIG. 1. The resultant fibers had an elliptical shape in cross section and a fineness of 65 dtex. The resultant fibers are referred to as "ellipse 65".

Manufacturing Example 4

The regenerated collagen fibers were manufactured in the same manner as in Manufacturing Example 1 except that the stock solution was passed through a spinning nozzle whose shape was elliptical as shown under the name of "ellipse 58" in FIG. 1. The resultant fibers had an elliptical shape in cross section and a fineness of 58 dtex. The resultant fibers are referred to as "ellipse 58".

Manufacturing Example 5

The regenerated collagen fibers were manufactured in the same manner as in Manufacturing Example 1 except that the stock solution was passed through a spinning nozzle whose shape was elliptical as shown under the name of "ellipse 52" in FIG. 1. The resultant fibers had an elliptical shape in cross section and a fineness of 52 dtex. The resultant fibers are referred to as "ellipse 52".

Manufacturing Example 6

The regenerated collagen fibers were manufactured in the same manner as in Manufacturing Example 1 except that a circular spinning nozzle (having a pore diameter of 0.22 mm) was used. The resultant fibers had a circular shape in cross section and a fineness of 52 dtex. The resultant fibers are referred to as "○ 52".

Manufacturing Example 7

The regenerated collagen fibers were manufactured in the same manner as in Manufacturing Example 1 except that a circular spinning nozzle (having a pore diameter of 0.25 mm) was used. The resultant fibers had a circular shape in cross section and a fineness of 65 dtex. The resultant fibers are referred to as "○ 65".

Manufacturing Example 8

The regenerated collagen fibers were manufactured in the same manner as in Manufacturing Example 1 except that a circular spinning nozzle (having a pore diameter of 0.19 mm) was used. The resultant fibers had a circular shape in cross section and a fineness of 39 dtex. The resultant fibers are referred to as "○ 39".

Manufacturing Example 9

The regenerated collagen fibers were manufactured in the same manner as in Manufacturing Example 1 except that a sexfoil spinning nozzle (whose shape is shown under the name of "* 52" in FIG. 3) was used. The resultant fibers had a sexfoil shape in cross section and a fineness of 52 dtex. The resultant fibers are referred to as "* 52".

Manufacturing Example 10

The regenerated collagen fibers were manufactured in the same manner as in Manufacturing Example 1 except that a sexfoil spinning nozzle (whose shape is shown under the name of "* 65" in FIG. 3) was used. The resultant fibers had a sexfoil shape in cross section and a fineness of 65 dtex. The resultant fibers are referred to as "* 65".

Manufacturing Example 11

The regenerated collagen fibers were manufactured in the same manner as in Manufacturing Example 1 except that a sexfoil spinning nozzle (whose shape is shown under the name of "* 39" in FIG. 3) was used. The resultant fibers had a sexfoil shape in cross section and a fineness of 39 dtex. The resultant fibers are referred to as "* 39".

Manufacturing Example 12

Polyethylene terephthalate ("BK-2180" manufactured by Mitsubishi Chemical Corporation) was dried until it had a moisture content of 100 ppm or less. Then, a molten polymer was extruded through a spinning nozzle whose nozzle holes are elliptical in cross section at an aspect ratio of 1:1.8 (major axis: 2.2 mm, minor axis: 1.22 mm), at a barrel temperature of 280° C. using a melt spinning machine ("SV30" manufactured by Shinko Ind. Ltd.). The resultant spun yarns were air-cooled with a cooling air at 20° C. and wound up at a speed of 100 m/minute, thereby providing undrawn yarns. The resultant undrawn yarns were drawn to 4 times its original length using a heating roller heated at 85° C., heat-treated using the heating roller heated at 180° C., and wound up at a speed of 30 m/minute. Thus, the resultant fibers had an elliptical shape in cross section and a fineness of 70 dtex. The resultant fibers are referred to as "ellipse 70 PET".

Manufacturing Example 13

The polyester fibers were manufactured in the same manner as in Manufacturing Example 12 except that a circular spinning nozzle (having a pore diameter of 1.3 mm) was used. The resultant fibers had a circular shape in cross section and a fineness of 50 dtex. The resultant fibers are referred to as "○ 50 PET".

Manufacturing Example 14

The polyester fibers were manufactured in the same manner as in Manufacturing Example 12 except that a sexfoil spinning nozzle (a: 1.44 mm, b: 1.05 mm, R: 0.26 mm in FIG. 28) was used. The resultant fibers had a sexfoil shape in cross section and a fineness of 50 dtex. The resultant fibers are referred to as "* 50 PET".

The results of the fibers obtained in Manufacturing Examples 1 to 14 above are summarized in Table 1.

TABLE 1

| Manufacturing Example No. | Name | Cross-sectional shape | Fineness (dtex) | Gloss rank |
|---|---|---|---|---|
| 1 | Ellipse 100 | Elliptical | 100 | 1 |
| 2 | Ellipse 78 | Elliptical | 78 | 1 |
| 3 | Ellipse 65 | Elliptical | 65 | 2 |
| 4 | Ellipse 58 | Elliptical | 58 | 2 |
| 5 | Ellipse 52 | Elliptical | 52 | 3 |
| 6 | ○ 52 | Circular | 52 | 4 |
| 7 | ○ 65 | Circular | 65 | 4 |
| 8 | ○ 39 | Circular | 39 | 4 |
| 9 | * 52 | Sexfoil | 52 | 5 |
| 10 | * 65 | Sexfoil | 65 | 5 |
| 11 | * 39 | Sexfoil | 39 | 5 |
| 12 | Ellipse 70 PET | Ellipstical | 70 | 1 |
| 13 | ○ 50 PET | Circular | 50 | 2 |
| 14 | * 50 PET | Sexfoil | 50 | 3 |

Figure 28:
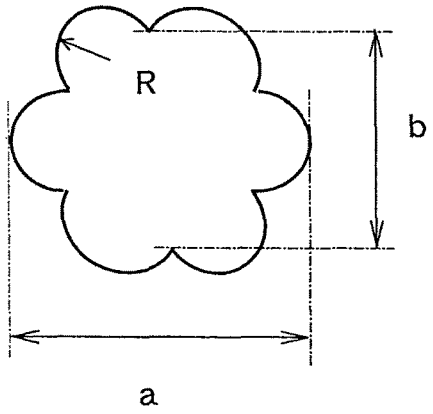
FIG. 28 is a view for explaining a cross section of a spinneret nozzle used for manufacturing the regenerated collagen fibers in Manufacturing Examples 9 to 11 of the present invention.

Further, the cross section of each of the regenerated collagen fibers is shown in FIGS. 1 to 3, and the shape of the spinneret nozzle having a sexfoil shape in cross section is shown in FIG. 28. In FIG. 28, a represents a circumscribed diameter of the sexfoil cross section, b represents an inscribed diameter of the sexfoil cross section, and R represents a radius of one leaf. Specific values are shown in FIG. 3.

Example 1

Figure 5:
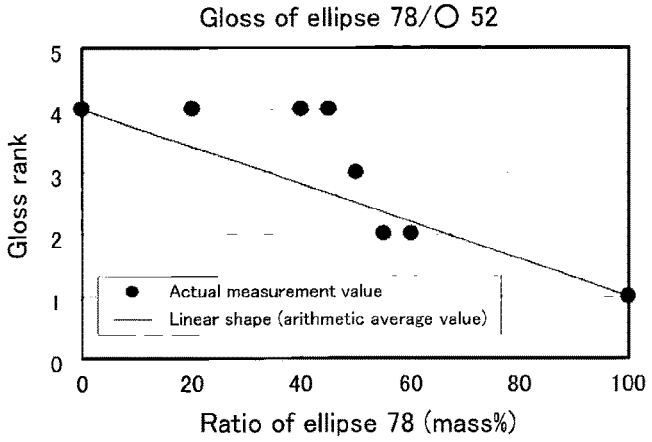
FIG. 5 is a graph showing a gloss rank of a fiber for artificial hair obtained in Example 1 of the present invention.

The fibers in Manufacturing Example 2 were combined with the fibers in Manufacturing Examples 9 and 6 respectively as shown in Table 2, and the gloss of the combined fibers was measured. The mixing ratio of the fibers and the results of the gloss of the combined fibers are shown in Table 2 and FIGS. 4 and 5.

TABLE 2

| Experiment No. | Ellipse 78 (mass %) | *52 (mass %) | ○ 52 (mass %) | Actual measurement value of gloss rank | Arithmetic average value |
|---|---|---|---|---|---|
| 1-1 (Ex.) | 1 | 99 | | 5 | 4.96 |
| 1-2 (Ex.) | 5 | 95 | | 5 | 4.8 |

TABLE 2-continued

| Experiment No. | Ellipse 78 (mass %) | *52 (mass %) | ○ 52 (mass %) | Actual measurement value of gloss rank | Arithmetic average value |
|---|---|---|---|---|---|
| 1-3 (Ex.) | 20 | 80 | | 5 | 4.2 |
| 1-4 (Ex.) | 40 | 60 | | 5 | 3.4 |
| 1-5 (Ex.) | 45 | 55 | | 4 | 3.2 |
| 1-6 (Com. Ex.) | 50 | 50 | | 3 | 3 |
| 1-7 (Com. Ex.) | 55 | 45 | | 2 | 2.8 |
| 1-8 (Com. Ex.) | 60 | 40 | | 2 | 2.6 |
| 1-9 (Ex.) | 20 | | 80 | 4 | 3.4 |
| 1-10 (Ex.) | 40 | | 60 | 4 | 2.8 |
| 1-11 (Ex.) | 45 | | 55 | 4 | 2.65 |
| 1-12 (Ex.) | 50 | | 50 | 3 | 2.5 |
| 1-13 (Com. Ex.) | 55 | | 45 | 2 | 2.35 |
| 1-14 (Com. Ex.) | 60 | | 40 | 2 | 2.2 |

As can be seen from Table 2, when 1 to 45 mass % of the regenerated collagen fibers having an elliptical shape in cross section were combined with the fibers having a sexfoil shape in cross section or when 20 to 50 mass % of the fibers having an elliptical shape in cross section were combined with the regenerated collagen fibers having a circular shape in cross section, the resultant fibers had a gloss rank that was synergistically higher than the arithmetic average value, resulting in an improved appearance with a suppressed gloss.

Example 2

Figure 6:
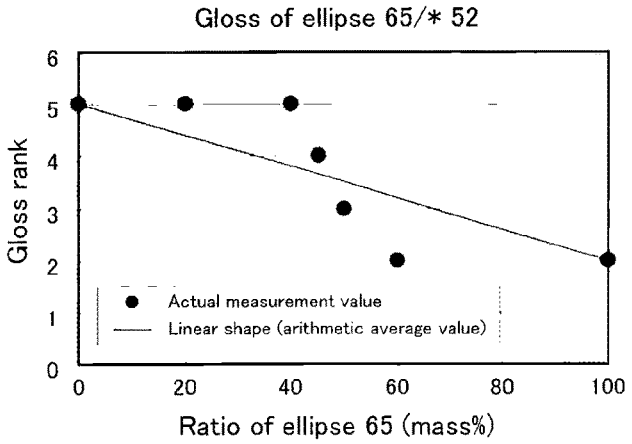
FIG. 6 is a graph showing a gloss rank of a fiber for artificial hair obtained in Example 2 of the present invention.
Figure 7:
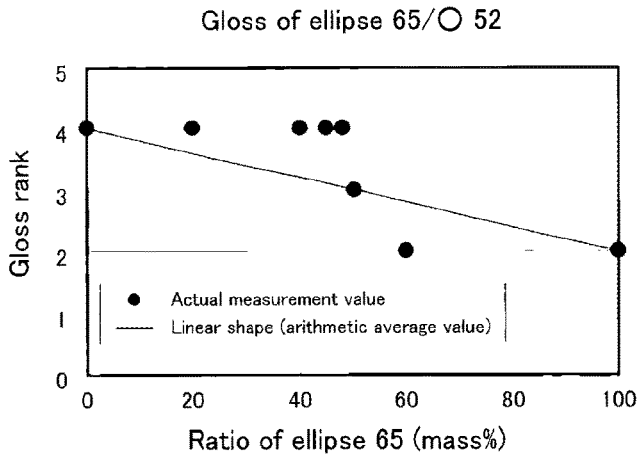
FIG. 7 is a graph showing a gloss rank of a fiber for artificial hair obtained in Example 2 of the present invention.

The fibers in Manufacturing Example 3 were combined with the fibers in Manufacturing Examples 9 and 6 respectively as shown in Table 3, and the gloss of the combined fibers was measured. The mixing ratio of the fibers and the results of the gloss of the combined fibers are shown in Table 3 and FIGS. 6 and 7.

TABLE 3

| Experiment No. | Ellipse 65 (mass %) | * 52 (mass %) | ○ 52 (mass %) | Actual measurement value of gloss rank | Arithmetic average value |
|---|---|---|---|---|---|
| 2-1 (Ex.) | 20 | 80 | | 5 | 4.4 |
| 2-2 (Ex.) | 40 | 60 | | 5 | 3.8 |
| 2-3 (Ex.) | 45 | 55 | | 4 | 3.65 |
| 2-4 (Com. Ex.) | 50 | 50 | | 3 | 3.5 |
| 2-5 (Com. Ex.) | 60 | 40 | | 2 | 3.2 |
| 2-6 (Ex.) | 20 | | 80 | 4 | 3.6 |
| 2-7 (Ex.) | 40 | | 60 | 4 | 3.2 |
| 2-8 (Ex.) | 45 | | 55 | 4 | 3.1 |
| 2-9 (Ex.) | 48 | | 52 | 4 | 3.04 |
| 2-10 (Com. Ex.) | 50 | | 50 | 3 | 3 |
| 2-11 (Com. Ex.) | 60 | | 40 | 2 | 2.8 |

As can be seen from Table 3, when 20 to 45 mass % of the regenerated collagen fibers having an elliptical shape in cross section were combined with the fibers having a sexfoil shape in cross section or when 20 to 48 mass % of the fibers having an elliptical shape in cross section were combined with the regenerated collagen fibers having a circular shape in cross section, the resultant fibers had a gloss rank that was synergistically higher than the arithmetic average value, resulting in an improved appearance with a suppressed gloss.

Example 3

Figure 8:
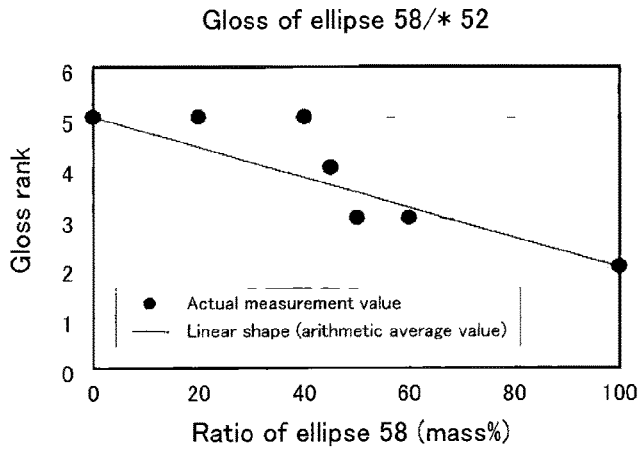
FIG. 8 is a graph showing a gloss rank of a fiber for artificial hair obtained in Example 3 of the present invention.
Figure 9:
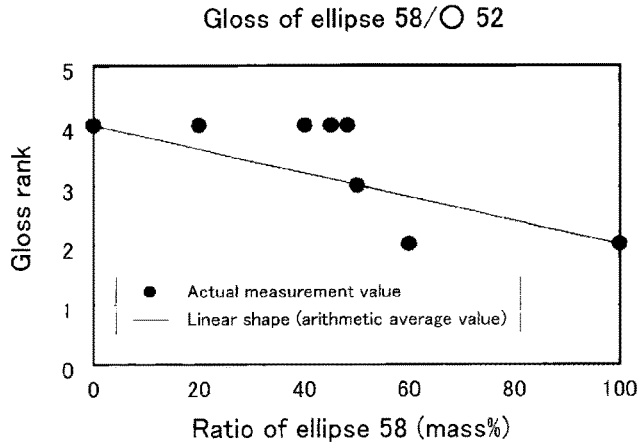
FIG. 9 is a graph showing a gloss rank of a fiber for artificial hair obtained in Example 3 of the present invention.

The fibers in Manufacturing Example 4 were combined with the fibers in Manufacturing Examples 9 and 6 respectively as shown in Table 4, and the gloss of the combined fibers was measured. The mixing ratio of the fibers and the results of the gloss of the combined fibers are shown in Table 4 and FIGS. 8 and 9.

TABLE 4

| Experiment No. | Ellipse 58 (mass %) | * 52 (mass %) | ○ 52 (mass %) | Actual measurement value of gloss rank | Arithmetic average value |
|---|---|---|---|---|---|
| 3-1 (Ex.) | 20 | 80 | | 5 | 4.4 |
| 3-2 (Ex.) | 40 | 60 | | 5 | 3.8 |
| 3-3 (Ex.) | 45 | 55 | | 4 | 3.65 |
| 3-4 (Com. Ex.) | 50 | 50 | | 3 | 3.5 |
| 3-5 (Com. Ex.) | 60 | 40 | | 3 | 3.2 |
| 3-6 (Ex.) | 20 | | 80 | 4 | 3.6 |
| 3-7 (Ex.) | 40 | | 60 | 4 | 3.2 |
| 3-8 (Ex.) | 45 | | 55 | 4 | 3.1 |
| 3-9 (Ex.) | 48 | | 52 | 4 | 3.04 |
| 3-10 (Com. Ex.) | 50 | | 50 | 3 | 3 |
| 3-11 (Com. Ex.) | 60 | | 40 | 2 | 2.8 |

As can be seen from Table 4, when 20 to 45 mass % of the regenerated collagen fibers having an elliptical shape in cross section were combined with the fibers having a sexfoil shape in cross section or when 20 to 48 mass % of the fibers having an elliptical shape in cross section were combined with the regenerated collagen fibers having a circular shape in cross section, the resultant fibers had a gloss rank that was synergistically higher than the arithmetic average value, resulting in an improved appearance with a suppressed gloss.

Example 4

Figure 10:
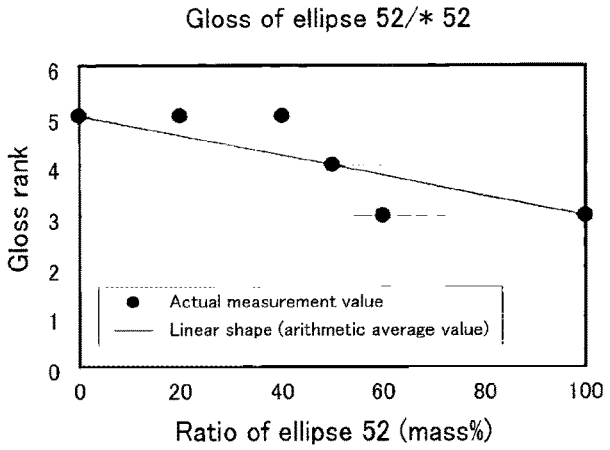
FIG. 10 is a graph showing a gloss rank of a fiber for artificial hair obtained in Example 4 of the present invention.
Figure 11:
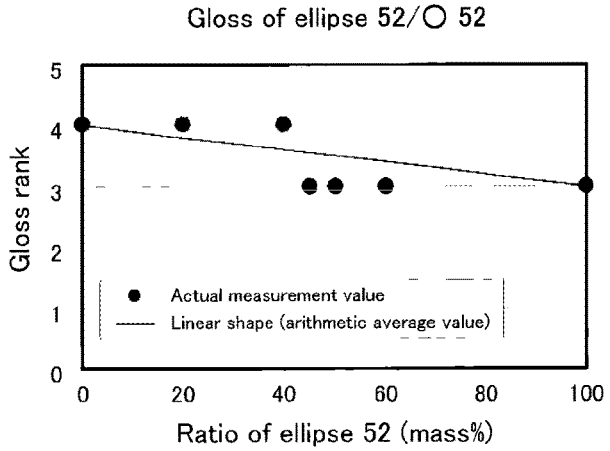
FIG. 11 is a graph showing a gloss rank of a fiber for artificial hair obtained in Example 4 of the present invention.
Figure 12:
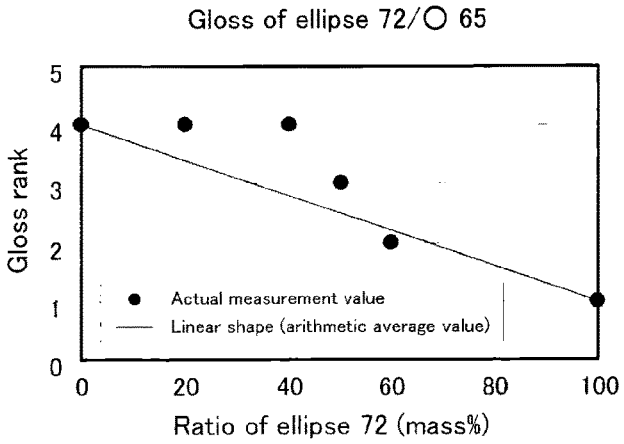
FIG. 12 is a graph showing a gloss rank of a fiber for artificial hair obtained in Example 5 of the present invention.
Figure 13:
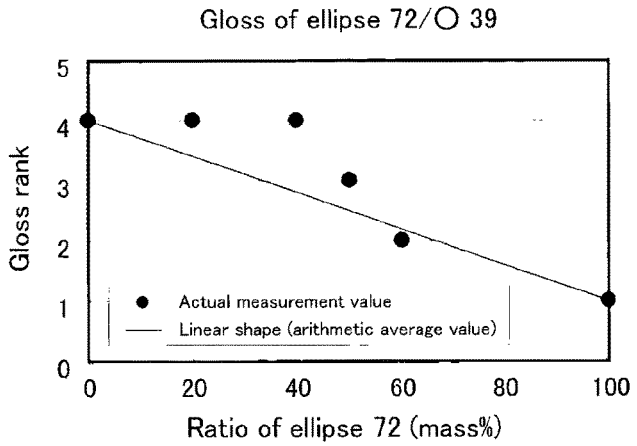
FIG. 13 is a graph showing a gloss rank of a fiber for artificial hair obtained in Example 5 of the present invention.
Figure 14:
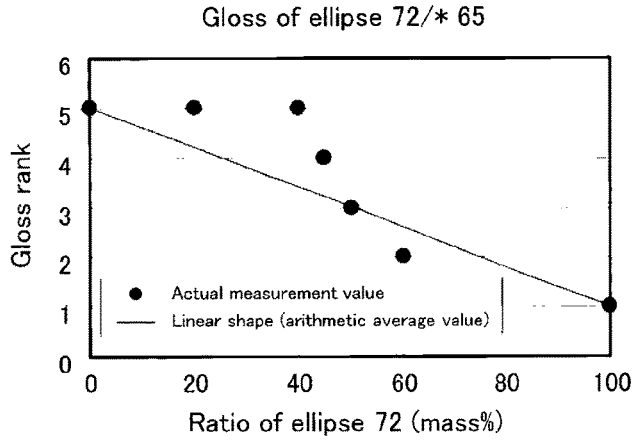
FIG. 14 is a graph showing a gloss rank of a fiber for artificial hair obtained in Example 5 of the present invention.
Figure 15:
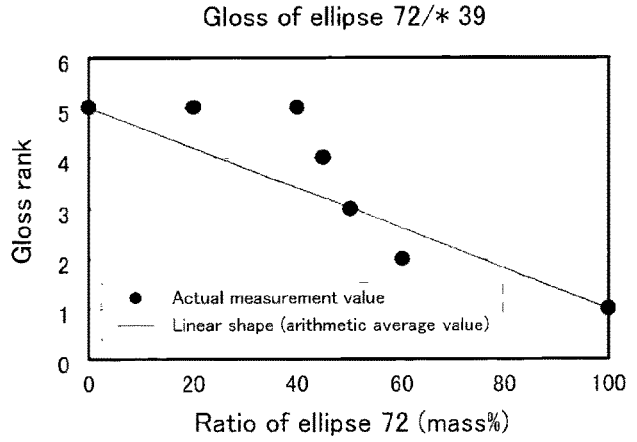
FIG. 15 is a graph showing a gloss rank of a fiber for artificial hair obtained in Example 5 of the present invention.

The fibers in Manufacturing Example 5 were combined with the fibers in Manufacturing Examples 6 and 9 respectively as shown in Table 5, and the gloss of the combined fibers was measured. The mixing ratio of the fibers and the results of the gloss of the combined fibers are shown in Table 5 and FIGS. 10 and 11.

TABLE 5

| Experiment No. | Ellipse 52 (mass %) | * 52 (mass %) | ○ 52 (mass %) | Actual measurement value of gloss rank | Arithmetic average value |
|---|---|---|---|---|---|
| 4-1 (Ex.) | 20 | 80 | | 5 | 4.6 |
| 4-2 (Ex.) | 40 | 60 | | 5 | 4.2 |
| 4-3 (Com. Ex.) | 50 | 50 | | 4 | 4 |
| 4-4 (Com. Ex.) | 60 | 40 | | 3 | 3.8 |
| 4-5 (Ex.) | 20 | | 80 | 4 | 3.8 |
| 4-6 (Ex.) | 40 | | 60 | 4 | 3.6 |
| 4-7 (Com. Ex.) | 45 | | 55 | 3 | 3.55 |
| 4-8 (Com. Ex.) | 50 | | 50 | 3 | 3.5 |
| 4-9 (Com. Ex.) | 60 | | 40 | 3 | 3.4 |

As can be seen from Table 5, when 20 to 40 mass % of the regenerated collagen fibers having an elliptical shape in cross section were combined with the fibers having a sexfoil shape in cross section or when 20 to 40 mass % of the fibers having an elliptical shape in cross section were combined with the regenerated collagen fibers having a circular shape in cross section, the resultant fibers had a gloss rank that was synergistically higher than the arithmetic average value, resulting in an improved appearance with a suppressed gloss.

Example 5

The fibers in Manufacturing Example 2 were combined with the fibers in

Manufacturing Examples 7, 8, 10, and 11 respectively as shown in Table 6, and the gloss of the combined fibers was measured. The mixing ratio of the fibers and the results of the gloss of the combined fibers are shown in Table 6 and FIGS. 12 to 15.

TABLE 6

| Experiment No. | Ellipse 78 (mass %) | ○ 65 (mass %) | ○ 39 (mass %) | * 65 (mass %) | * 39 (mass %) | Actual measurement value of gloss rank | Arithmetic average value |
|---|---|---|---|---|---|---|---|
| 5-1 (Ex.) | 20 | 80 | | | | 4 | 3.4 |
| 5-2 (Ex.) | 40 | 60 | | | | 4 | 2.8 |
| 5-3 (Ex.) | 50 | 50 | | | | 3 | 2.5 |
| 5-4 (Com. Ex.) | 60 | 40 | | | | 2 | 2.2 |
| 5-5 (Ex.) | 20 | | 80 | | | 4 | 3.4 |
| 5-6 (Ex.) | 40 | | 60 | | | 4 | 2.8 |
| 5-7 (Ex.) | 50 | | 50 | | | 3 | 2.5 |
| 5-8 (Com. Ex.) | 60 | | 40 | | | 2 | 2.2 |
| 5-9 (Ex.) | 20 | | | 80 | | 5 | 4.2 |
| 5-10 (Ex.) | 40 | | | 60 | | 5 | 3.4 |
| 5-11 (Ex.) | 45 | | | 55 | | 4 | 3.2 |
| 5-12 (Com. Ex.) | 50 | | | 50 | | 3 | 3 |
| 5-13 (Com. Ex.) | 60 | | | 40 | | 2 | 2.6 |
| 5-14 (Ex.) | 20 | | | | 80 | 5 | 4.2 |
| 5-15 (Ex.) | 40 | | | | 60 | 5 | 3.4 |
| 5-16 (Ex.) | 45 | | | | 55 | 4 | 3.2 |
| 5-17 (Com. Ex.) | 50 | | | | 50 | 3 | 3 |
| 5-18 (Com. Ex.) | 60 | | | | 40 | 2 | 2.6 |

As can be seen from Table 6, when 20 to 50 mass % of the regenerated collagen fibers having an elliptical shape in cross section were combined, the resultant fibers had a gloss rank that was synergistically higher than the arithmetic average value, resulting in an improved appearance with a suppressed gloss.

Example 6

Figure 16:
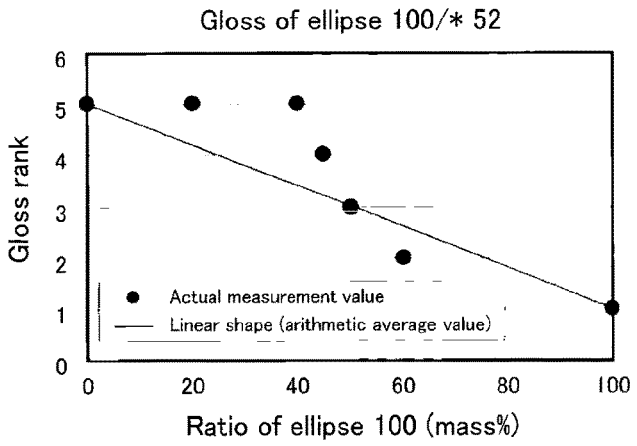
FIG. 16 is a graph showing a gloss rank of a fiber for artificial hair obtained in Example 6 of the present invention.
Figure 17:
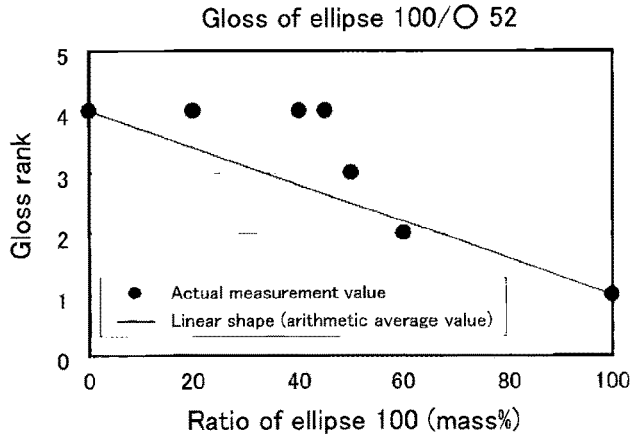
FIG. 17 is a graph showing a gloss rank of a fiber for artificial hair obtained in Example 6 of the present invention.
Figure 18:
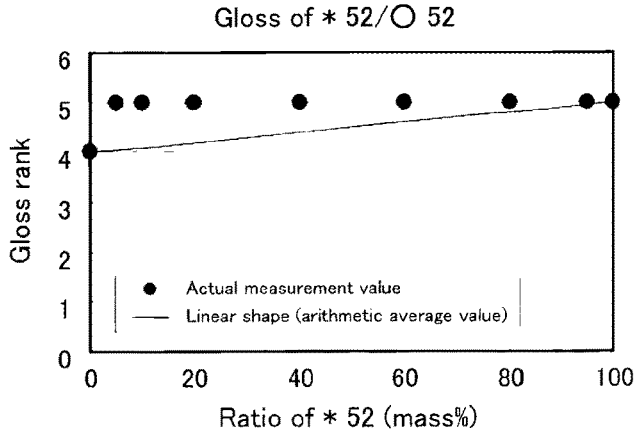
FIG. 18 is a graph showing a gloss rank of a fiber for artificial hair obtained in Example 6 of the present invention.
Figure 19:
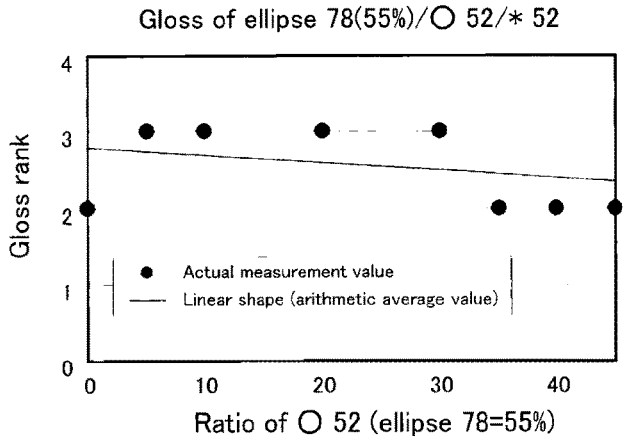
FIG. 19 is a graph showing a gloss rank of a fiber for artificial hair obtained in Example 7 of the present invention.
Figure 20:
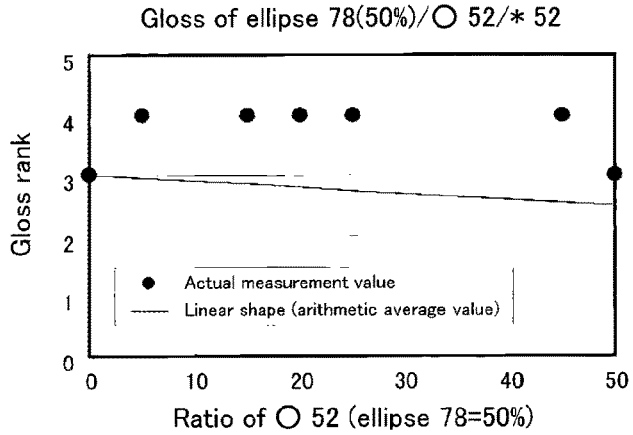
FIG. 20 is a graph showing a gloss rank of a fiber for artificial hair obtained in Example 7 of the present invention.
Figure 21:
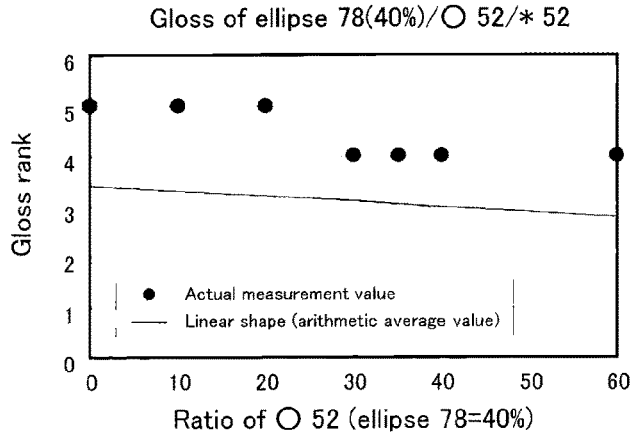
FIG. 21 is a graph showing a gloss rank of a fiber for artificial hair obtained in Example 7 of the present invention.
Figure 22:
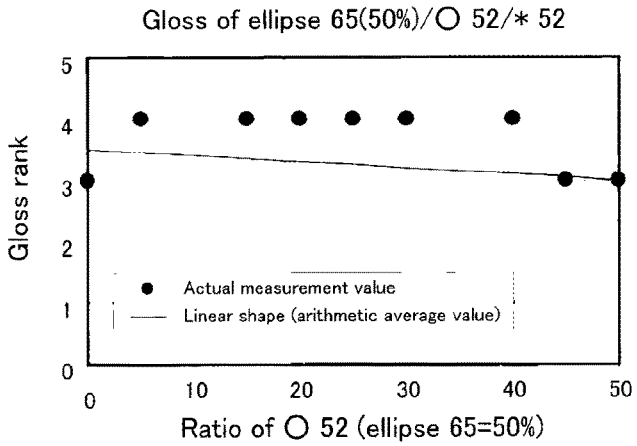
FIG. 22 is a graph showing a gloss rank of a fiber for artificial hair obtained in Example 7 of the present invention.
Figure 23:
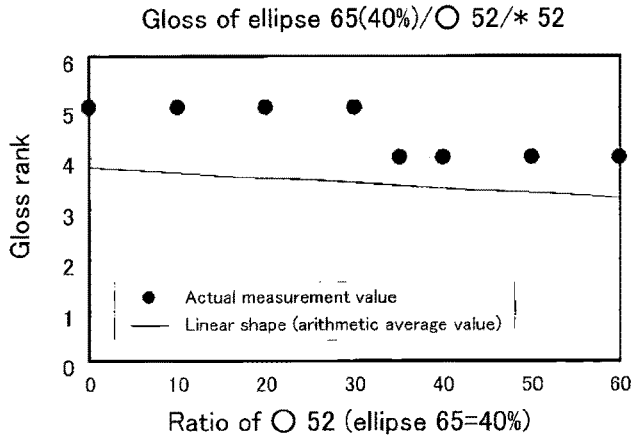
FIG. 23 is a graph showing a gloss rank of a fiber for artificial hair obtained in Example 7 of the present invention.
Figure 24:
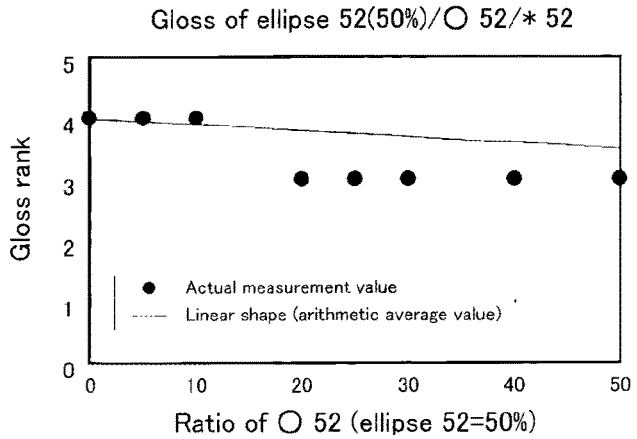
FIG. 24 is a graph showing a gloss rank of a fiber for artificial hair obtained in Example 8 of the present invention.
Figure 25:
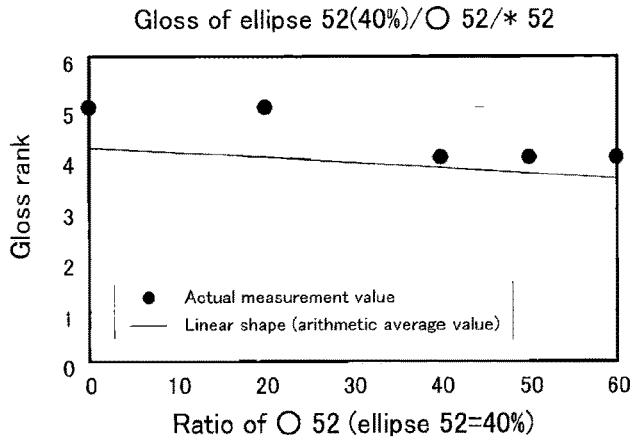
FIG. 25 is a graph showing a gloss rank of a fiber for artificial hair obtained in Example 8 of the present invention.
Figure 26:
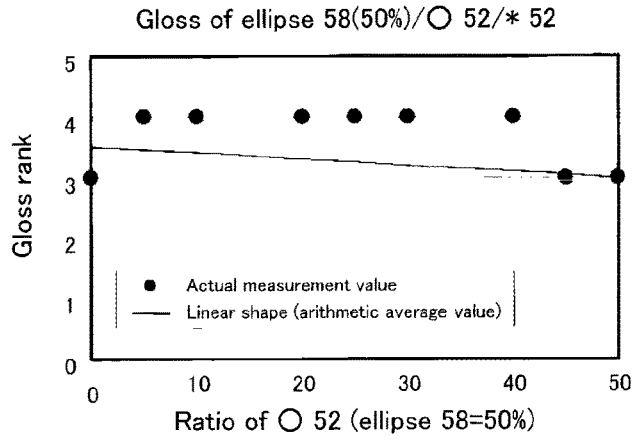
FIG. 26 is a graph showing a gloss rank of a fiber for artificial hair obtained in Example 8 of the present invention.
Figure 27:
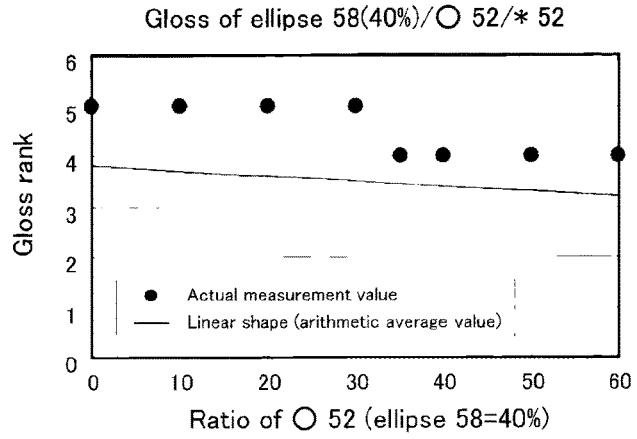
FIG. 27 is a graph showing a gloss rank of a fiber for artificial hair obtained in Example 8 of the present invention.

The fibers in Manufacturing Examples 1, 6, and 9 were combined as shown in Table 7, and the gloss of the combined fibers was measured. The mixing ratio of the fibers and the results of the gloss of the combined fibers are shown in Table 7 and FIGS. 16 to 18.

TABLE 7

| Experiment No. | Ellipse 100 (mass %) | * 52 (mass %) | ○ 52 (mass %) | Actual measurement value of gloss rank | Arithmetic average value |
|---|---|---|---|---|---|
| 6-1 (Ex.) | 20 | 80 | | 5 | 4.2 |
| 6-2 (Ex.) | 40 | 60 | | 5 | 3.4 |
| 6-3 (Ex.) | 45 | 55 | | 4 | 3.2 |
| 6-4 (Com. Ex.) | 50 | 50 | | 3 | 3 |
| 6-5 (Com. Ex.) | 60 | 40 | | 2 | 2.6 |
| 6-6 (Ex.) | 20 | | 80 | 4 | 3.4 |
| 6-7 (Ex.) | 40 | | 60 | 4 | 2.8 |
| 6-8 (Ex.) | 45 | | 55 | 4 | 2.65 |
| 6-9 (Ex.) | 50 | | 50 | 3 | 2.5 |
| 6-10 (Com. Ex.) | 60 | | 40 | 2 | 2.2 |
| 6-11 (Ex.) | | 5 | 95 | 5 | 4.05 |
| 6-12 (Ex.) | | 10 | 90 | 5 | 4.1 |
| 6-13 (Ex.) | | 20 | 80 | 5 | 4.2 |
| 6-14 (Ex.) | | 40 | 60 | 5 | 4.4 |

TABLE 7-continued

| Experiment No. | Ellipse 100 (mass %) | * 52 (mass %) | ○ 52 (mass %) | Actual measurement value of gloss rank | Arithmetic average value |
|---|---|---|---|---|---|
| 6-15 (Ex.) | | 60 | 40 | 5 | 4.6 |
| 6-16 (Ex.) | | 80 | 20 | 5 | 4.8 |
| 6-17 (Ex.) | | 95 | 5 | 5 | 4.95 |

As can be seen from Table 7, when 20 to 45 mass % of the ellipse 100 fibers were combined with the * 52 fibers, when 20 to 50 mass % of the ellipse 100 fibers were combined with the ○ 52 fibers, or when 5 to 95 mass % of the * 52 fibers were combined with the ○ 52 fibers, the resultant fibers had a gloss rank that was synergistically higher than the arithmetic average value, resulting in an improved appearance with a suppressed gloss.

Example 7

The fibers in Manufacturing Example 2 or 3 were combined with the fibers in

Manufacturing Examples 6 and 9 as shown in Table 8, and the gloss of the combined fibers was measured. The mixing ratio of the fibers and the results of the gloss of the combined fibers are shown in Table 8 and FIGS. 19 to 23.

TABLE 8

| Experiment No. | Ellipse 78 (mass %) | Ellipse 65 (mass %) | ○ 52 (mass %) | * 52 (mass %) | Actual measurement value of gloss rank | Arithmetic average value |
|---|---|---|---|---|---|---|
| 8-1 (Com. Ex.) | 55 | | 45 | 0 | 2 | 2.35 |
| 8-2 (Com. Ex.) | 55 | | 40 | 5 | 2 | 2.4 |
| 8-3 (Com. Ex.) | 55 | | 35 | 10 | 2 | 2.45 |
| 8-4 (Ex.) | 55 | | 30 | 15 | 3 | 2.5 |
| 8-5 (Ex.) | 55 | | 20 | 25 | 3 | 2.6 |
| 8-6 (Ex.) | 55 | | 10 | 35 | 3 | 2.7 |
| 8-7 (Ex.) | 55 | | 5 | 40 | 3 | 2.75 |
| 8-8 (Com. Ex.) | 55 | | 0 | 45 | 2 | 2.8 |
| 8-9 (Ex.) | 50 | | 50 | 0 | 3 | 2.5 |
| 8-10 (Ex.) | 50 | | 45 | 5 | 4 | 2.55 |
| 8-11 (Ex.) | 50 | | 25 | 25 | 4 | 2.75 |
| 8-12 (Ex.) | 50 | | 20 | 30 | 4 | 2.8 |
| 8-13 (Ex.) | 50 | | 15 | 35 | 4 | 2.85 |
| 8-14 (Ex.) | 50 | | 5 | 45 | 4 | 2.95 |
| 8-15 (Com. Ex.) | 50 | | 0 | 50 | 3 | 3 |
| 8-16 (Ex.) | 40 | | 60 | 0 | 4 | 2.8 |
| 8-17 (Ex.) | 40 | | 40 | 20 | 4 | 3 |
| 8-18 (Ex.) | 40 | | 35 | 25 | 4 | 3.05 |
| 8-19 (Ex.) | 40 | | 30 | 30 | 4 | 3.1 |
| 8-20 (Ex.) | 40 | | 20 | 40 | 5 | 3.2 |
| 8-21 (Ex.) | 40 | | 10 | 50 | 5 | 3.3 |
| 8-22 (Ex.) | 40 | | 0 | 60 | 5 | 3.4 |
| 8-23 (Com. Ex.) | | 50 | 50 | 0 | 3 | 3 |
| 8-24 (Com. Ex.) | | 50 | 45 | 5 | 3 | 3.05 |
| 8-25 (Ex.) | | 50 | 40 | 10 | 4 | 3.1 |
| 8-26 (Ex.) | | 50 | 30 | 20 | 4 | 3.2 |
| 8-27 (Ex.) | | 50 | 25 | 25 | 4 | 3.25 |
| 8-28 (Ex.) | | 50 | 20 | 30 | 4 | 3.3 |
| 8-29 (Ex.) | | 50 | 15 | 35 | 4 | 3.35 |
| 8-30 (Ex.) | | 50 | 5 | 45 | 4 | 3.45 |
| 8-31 (Com. Ex.) | | 50 | 0 | 50 | 3 | 3.5 |
| 8-32 (Ex.) | | 40 | 60 | 0 | 4 | 3.2 |
| 8-33 (Ex.) | | 40 | 50 | 10 | 4 | 3.3 |
| 8-34 (Ex.) | | 40 | 40 | 20 | 4 | 3.4 |
| 8-35 (Ex.) | | 40 | 35 | 25 | 4 | 3.45 |
| 8-36 (Ex.) | | 40 | 30 | 30 | 5 | 3.5 |
| 8-37 (Ex.) | | 40 | 20 | 40 | 5 | 3.6 |
| 8-38 (Ex.) | | 40 | 10 | 50 | 5 | 3.7 |
| 8-39 (Ex.) | | 40 | 0 | 60 | 5 | 3.8 |

As can be seen from Table 8 (for three kinds of shapes, i.e., an elliptical shape, a circular shape, and a sexfoil shape, in cross section), when 55 mass % of the ellipse 78 fibers were combined with the ○ 52 fibers and the * 52 fibers in a ratio of 5/40 to 30/15, when 50 mass % of the ellipse 78 fibers were combined with the ○ 52 fibers and the * 52 fibers in a ratio of 5/45 to 50/0, when 40 mass % of the ellipse 78 fibers were combined with the ○ 52 fibers and the * 52 fibers in a ratio of 0/60 to 60/0, when 50 mass % of the ellipse 65 fibers were combined with the ○ 52 fibers and the * 52 fibers in a ratio of 5/45 to 45/5, and when 40 mass % of the ellipse 65 fibers were combined with the 0 52 fibers and the * 52 fibers in a ratio of 0/60 to 60/0, the resultant fibers had a gloss rank that was synergistically higher than the arithmetic average value, resulting in an improved appearance with a suppressed gloss.

Example 8

The fibers in Manufacturing Example 4 or 5 were combined with the fibers in Manufacturing Examples 6 and 9 as shown in Table 9, and the gloss of the combined fibers was measured. The mixing ratio of the fibers and the results of the gloss of the combined fibers are shown in Table 9 and FIGS. 24 to 27.

TABLE 9

| Experiment No. | Ellipse 58 (mass %) | Ellipse 52 (mass %) | ○ 52 (mass %) | * 52 (mass %) | Actual measurement value of gloss rank | Arithmetic average value |
|---|---|---|---|---|---|---|
| 9-1 (Com. Ex.) | | 50 | 50 | 0 | 3 | 3.5 |
| 9-2 (Com. Ex.) | | 50 | 40 | 10 | 3 | 3.6 |
| 9-3 (Com. Ex.) | | 50 | 30 | 20 | 3 | 3.7 |
| 9-4 (Com. Ex.) | | 50 | 25 | 25 | 3 | 3.75 |
| 9-5 (Com. Ex.) | | 50 | 20 | 30 | 3 | 3.8 |
| 9-6 (Ex.) | | 50 | 10 | 40 | 4 | 3.9 |
| 9-7 (Ex.) | | 50 | 5 | 45 | 4 | 3.95 |
| 9-8 (Ex.) | | 50 | 0 | 50 | 4 | 4 |
| 9-9 (Ex.) | | 40 | 60 | 0 | 4 | 3.6 |
| 9-10 (Ex.) | | 40 | 50 | 10 | 4 | 3.7 |
| 9-11 (Ex.) | | 40 | 40 | 20 | 4 | 3.8 |
| 9-12 (Ex.) | | 40 | 20 | 40 | 5 | 4 |
| 9-13 (Ex.) | | 40 | 0 | 60 | 5 | 4.2 |
| 9-14 (Com. Ex.) | 50 | | 50 | 0 | 3 | 3 |
| 9-15 (Com. Ex.) | 50 | | 45 | 5 | 3 | 3.05 |
| 9-16 (Ex.) | 50 | | 40 | 10 | 4 | 3.1 |
| 9-17 (Ex.) | 50 | | 30 | 20 | 4 | 3.2 |
| 9-18 (Ex.) | 50 | | 25 | 25 | 4 | 3.25 |
| 9-19 (Ex.) | 50 | | 20 | 30 | 4 | 3.3 |
| 9-20 (Ex.) | 50 | | 10 | 40 | 4 | 3.4 |
| 9-21 (Ex.) | 50 | | 5 | 45 | 4 | 3.45 |
| 9-22 (Com. Ex.) | 50 | | 0 | 50 | 3 | 3.5 |
| 9-23 (Ex.) | 40 | | 60 | 0 | 4 | 3.2 |
| 9-24 (Ex.) | 40 | | 50 | 10 | 4 | 3.3 |
| 9-25 (Ex.) | 40 | | 40 | 20 | 4 | 3.4 |
| 9-26 (Ex.) | 40 | | 35 | 25 | 4 | 3.45 |
| 9-27 (Ex.) | 40 | | 30 | 30 | 5 | 3.5 |
| 9-28 (Ex.) | 40 | | 20 | 40 | 5 | 3.6 |
| 9-29 (Ex.) | 40 | | 10 | 50 | 5 | 3.7 |
| 9-30 (Ex.) | 40 | | 0 | 60 | 5 | 3.8 |

As can be seen from Table 9 (for three kinds of shapes, i.e., an elliptical shape, a circular shape, and a sexfoil shape, in cross section), when 50 mass % of the ellipse 52 fibers were combined with the ○ 52 fibers and the * 52 fibers in a ratio of 5/45 to 10/40, when 40 mass % of the ellipse 52 fibers were combined with the ○ 52 fibers and the * 52 fibers in a ratio of 0/60 to 60/0, when 50 mass % of the ellipse 58 fibers were combined with the ○ 52 fibers and the * 52 fibers in a ratio of 5/45 to 40/10, and when 40 mass % of the ellipse 58 fibers were combined with the ○ 52 fibers and the * 52 fibers in a ratio of 0/60 to 60/0, the resultant fibers had a gloss rank that was synergistically higher than the arithmetic average value, resulting in an improved appearance with a suppressed gloss.

Example 9

The fibers in Manufacturing Examples 6 (○ 52) and 9 (* 52) were combined with polyester fibers (manufactured by Kaneka Corporation under the trade name of "FUTURA" with a fineness of 65 dtex) and modacrylic fibers (manufactured by Kaneka Corporation under the trade name of "BRITE" with a fineness of 58.8 dtex) respectively at a ratio shown in Table 10. The results are shown in Table 10.

TABLE 10

| Experiment No. | ○ 52 (mass %) | * 52 (mass %) | Polyester fiber(1) (mass %) | Modacrylic fiber(2) (mass %) | Actual measurement value of gloss rank | Arithmetic average value |
|---|---|---|---|---|---|---|
| 10-1 (Com. Ex.) | — | — | 100 | — | 3 | 3 |
| 10-2 (Com. Ex.) | — | — | — | 100 | 2 | 2 |
| 10-3 (Ex.) | 20 | 30 | 50 | — | 5 | 3.8 |
| 10-4 (Ex.) | 20 | 30 | — | 50 | 4 | 3.3 |

Remarks (1): Polyester fiber manufactured by Kaneka Corporation under the trade name of "FUTURA" with a fineness of 65 dtex
Remarks (2): Modacrylic fiber manufactured by Kaneka Corporation under the trade name of "BRITE" with a fineness of 58.8 dtex As is apparent from Table 10, the products according to the examples of the present invention (Nos. 10-3 and 10-4) had an improved appearance with a low gloss.

Comparative Example 1

Figure 29:
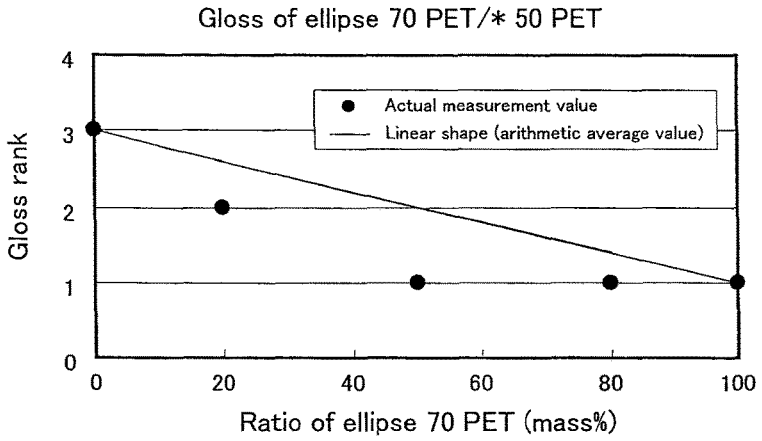
FIG. 29 is a graph showing a gloss rank of a fiber for artificial hair obtained in Comparative Example 1 of the present invention.
Figure 30:
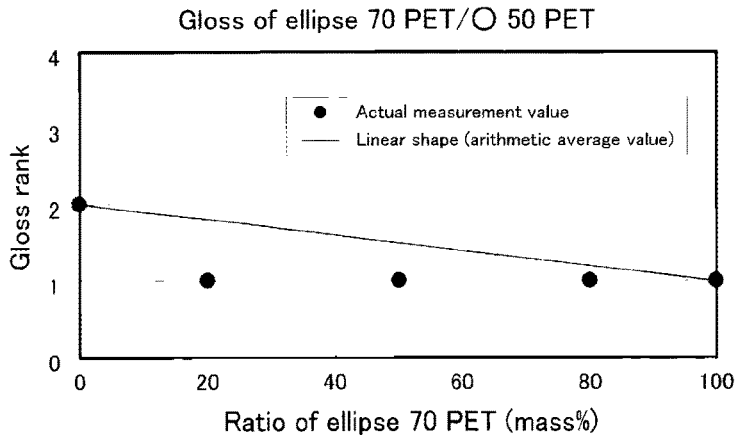
FIG. 30 is a graph showing a gloss rank of a fiber for artificial hair obtained in Comparative Example 1 of the present invention.
Figure 31:
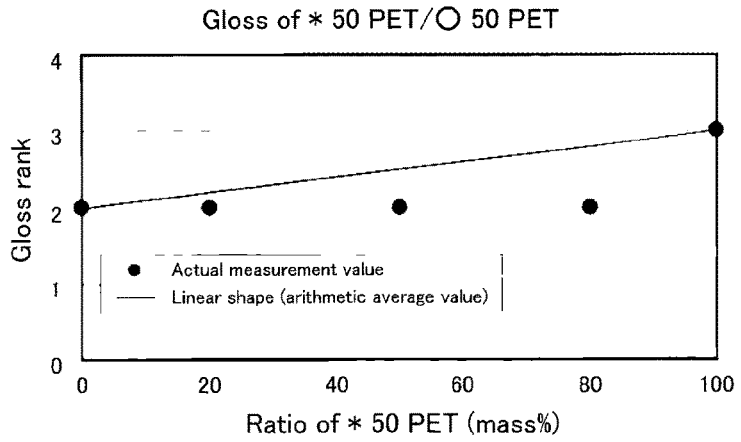
FIG. 31 is a graph showing a gloss rank of a fiber for artificial hair obtained in Comparative Example 1 of the present invention.
Figure 32:
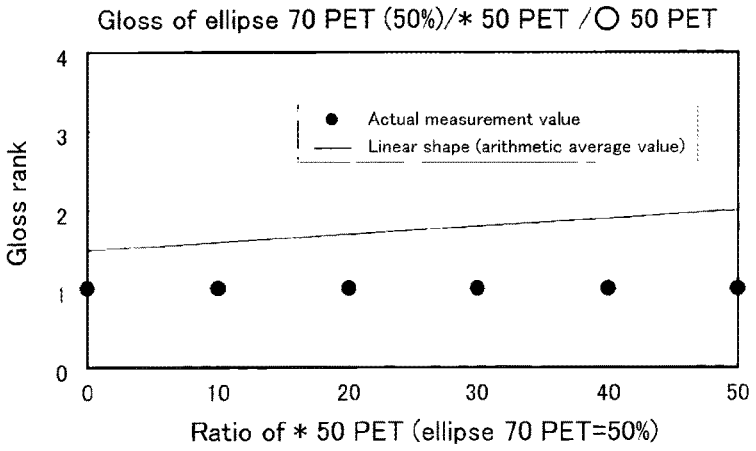
FIG. 32 is a graph showing a gloss rank of a fiber for artificial hair obtained in Comparative Example 1 of the present invention.

The polyester fibers obtained in Manufacturing Examples 12 to 14 were combined at a ratio shown in Table 11, and the gloss of the combined fibers was measured. The results are shown in Table 11 and FIGS. 29 to 31.

TABLE 11

| Experiment No. | Ellipse 70 PET (mass %) | * 50 PET (mass %) | ○ 50 PET (mass %) | Actual measurement value of gloss rank | Arithmetic average value |
|---|---|---|---|---|---|
| 11-1 | 20 | 80 | | 2 | 2.6 |
| 11-2 | 50 | 50 | | 1 | 2 |
| 11-3 | 80 | 20 | | 1 | 1.4 |
| 11-4 | 20 | | 80 | 1 | 1.8 |
| 11-5 | 50 | | 50 | 1 | 1.5 |
| 11-6 | 80 | | 20 | 1 | 1.2 |
| 11-7 | | 20 | 80 | 2 | 2.2 |
| 11-8 | | 50 | 50 | 2 | 2.5 |
| 11-9 | | 80 | 20 | 2 | 2.8 |
| 11-10 | 50 | 0 | 50 | 1 | 1.5 |
| 11-11 | 50 | 10 | 40 | 1 | 1.6 |
| 11-12 | 50 | 20 | 30 | 1 | 1.7 |
| 11-13 | 50 | 30 | 20 | 1 | 1.8 |
| 11-14 | 50 | 40 | 10 | 1 | 1.9 |
| 11-15 | 50 | 50 | 0 | 1 | 2 |

As is apparent from Table 11, all the resultant fibers in Comparative Example 1, which include two or more types of polyester fibers whose cross-sectional shapes are selected from the group consisting of shapes including an elliptical shape, a circular shape, and a multifoil shape but do not include any regenerated collagen fibers, had a gloss rank that was relatively lower than the arithmetic average value.

The invention claimed is:

1. Fibers for artificial hair obtained by combining fibers having different shapes in cross section, wherein the fibers for artificial hair comprise regenerated collagen fibers, and the regenerated collagen fibers include at least two types of regenerated collagen fibers whose cross-sectional shapes are selected from the group consisting of shapes including an elliptical shape, a circular shape, and a multifoil shape, wherein 1 to 49 mass % of the regenerated collagen fibers having an elliptical shape in cross section are combined.

2. Fibers for artificial hair obtained by combining fibers having different shapes in cross section, wherein the fibers for artificial hair comprise regenerated collagen fibers, and the regenerated collagen fibers include at least two types of regenerated collagen fibers whose cross-sectional shapes are selected from the group consisting of shapes including an elliptical shape, a circular shape, and a multifoil shape, wherein the fibers for artificial hair comprise only the regenerated collagen fibers, wherein 20 to 45 mass % of the regenerated collagen fibers having an elliptical shape in cross section are combined.

3. Fibers for artificial hair obtained by combining fibers having different shapes in cross section, wherein the fibers for artificial hair comprise regenerated collagen fibers, and the regenerated collagen fibers include at least two types of regenerated collagen fibers whose cross-sectional shapes are selected from the group consisting of shapes including an elliptical shape, a circular shape, and a multifoil shape, wherein 50 to 100 mass % inclusive of the regenerated collagen fibers are combined with 0 to 50 mass % inclusive of other fibers, wherein 1 to 49 mass % of the regenerated collagen fibers having an elliptical shape in cross section are combined.

* * * * *